US012292192B2

(12) United States Patent
Huta

(10) Patent No.: US 12,292,192 B2
(45) Date of Patent: May 6, 2025

(54) INTAKE DEVICE FOR A CHIMNEY TERMINATION

(71) Applicant: RLH INDUSTRIES, INC., Gaylord, MI (US)

(72) Inventor: Robert M. Huta, Gaylord, MI (US)

(73) Assignee: RLH INDUSTRIES, INC., Gaylord, MI (US)

( * ) Notice: Subject to any disclaimer, the term of this patent is extended or adjusted under 35 U.S.C. 154(b) by 539 days.

(21) Appl. No.: 17/631,520

(22) PCT Filed: Aug. 10, 2020

(86) PCT No.: PCT/US2020/045646

§ 371 (c)(1),
(2) Date: Jan. 31, 2022

(87) PCT Pub. No.: WO2021/030281

PCT Pub. Date: Feb. 18, 2021

(65) Prior Publication Data

US 2022/0268441 A1 Aug. 25, 2022

Related U.S. Application Data

(60) Provisional application No. 62/884,859, filed on Aug. 9, 2019.

(51) Int. Cl.

| | |
|---|---|
| ***F23L 17/04*** | (2006.01) |
| ***F23J 13/08*** | (2006.01) |
| ***F23L 17/08*** | (2006.01) |

(52) U.S. Cl.
CPC ..... *F23L 17/04* (2013.01); *F23J 13/08* (2013.01); *F23L 17/08* (2013.01)

(58) Field of Classification Search
CPC .. F23L 17/02; F23L 17/08; F23L 17/04; F23J 2213/50; F23J 13/08
(Continued)

(56) References Cited

U.S. PATENT DOCUMENTS 2,764,972 A * 10/1956 Ryder ..... F23J 13/025 126/307 R
3,040,734 A 6/1962 Field
(Continued)

FOREIGN PATENT DOCUMENTS

| | | |
|---|---|---|
| CA | 2448369 A1 | 5/2004 |
| DE | 221179 C | 4/1910 |
| JP | S5952123 A | 3/1984 |

OTHER PUBLICATIONS

Extended European Search Report for European Application No. EP20852450.4, dated Aug. 4, 2023, 8 Pages.
(Continued)

*Primary Examiner* — Ko-Wei Lin
(74) *Attorney, Agent, or Firm* — Brooks Kushman P.C.

(57) ABSTRACT

A termination assembly for a chimney is provided having an exhaust layer with an exhaust tube adapted to receive exhaust air from an appliance. An outlet opening of the exhaust tube terminates in the exhaust layer. An intake layer is separated from the exhaust layer. The intake layer has an enclosure defining a positive pressure area within the enclosure and a plurality of openings. Each of openings has a cross-sectional area that decreases from an exterior surface of the enclosure toward the positive pressure area within the enclosure. An intake tube is adapted to receive intake air at an inlet opening positioned in the positive pressure area. The positive pressure area in the intake layer has a pressure greater than the atmospheric pressure outside the termination and in the exhaust layer to prevent flow in the exhaust tube from being reversed.

20 Claims, 8 Drawing Sheets

(58) Field of Classification Search
USPC ..... 454/4–9
See application file for complete search history.

(56) References Cited

U.S. PATENT DOCUMENTS

| | | | | |
|---|---|---|---|---|
| 3,691,930 | A | 9/1972 | Steinman | |
| 4,200,038 | A | 4/1980 | Briner et al. | |
| 4,286,569 | A * | 9/1981 | Bergman | F23L 17/04 62/239 |
| 5,997,295 | A | 12/1999 | Mattson et al. | |
| 7,458,888 | B2 | 12/2008 | Huta | |
| 9,377,196 | B2 * | 6/2016 | Burns | F23L 17/04 |
| 2008/0207105 | A1 * | 8/2008 | Huta | F23L 17/02 454/4 |
| 2011/0165832 | A1 * | 7/2011 | Smith | B60H 1/00278 454/139 |

OTHER PUBLICATIONS

International Preliminary Report on Patentability for PCT/US2020/45646, mailed Feb. 17, 2022, 8 pages.
International Search Report and Written Opinion for PCT/US2020/45646, mailed Nov. 4, 2020, 12 pages.

* cited by examiner

INTAKE DEVICE FOR A CHIMNEY TERMINATION

CROSS-REFERENCE TO RELATED APPLICATION

This application is the U.S. national phase of PCT Application No. PCT/US2020/045646 filed on Aug. 10, 2020, which claims the benefit of U.S. provisional application Ser. No. 62/884,859 filed Aug. 9, 2019, the disclosures of which are hereby incorporated in their entirety by reference herein.

TECHNICAL FIELD

A device for a chimney termination is provided that creates positive pressure along the intake of the termination.

BACKGROUND

Chimney vent termination assemblies are available in a variety of different shapes and sizes. Generally, the chimney termination assembly is attached to the vent pipes of an appliance. One example is U.S. Pat. No. 7,458,888.

SUMMARY

In at least one embodiment, a termination assembly for a chimney is provided having an intake tube adapted to receive intake air to be delivered to an appliance. An exhaust tube is adapted to receive exhaust air from the appliance, the exhaust tube terminating in an exhaust layer. An intake layer is disposed above or below the exhaust layer. The intake layer has a first ring and mounted to an exhaust plate separating the exhaust layer from the intake layer. At least one frustoconical ring is spaced apart from the first ring and directs intake air at an angle toward the first ring into a positive pressure area. An intake plate is mounted to the frustoconical ring opposite the first ring. The positive pressure area is defined within the first ring and the frustoconical ring and between the exhaust plate and the inlet plate. The intake tube originates in the positive pressure area.

In at least one embodiment, a termination assembly for a chimney is provided having an exhaust layer with an exhaust tube adapted to receive exhaust air from an appliance, where an outlet opening of the exhaust tube terminates in the exhaust layer. An intake layer is separated from the exhaust layer. The intake layer has an enclosure defining a positive pressure area within the enclosure and a plurality of openings directing intake air at an angle toward the positive pressure area. An intake tube is adapted to receive intake air at an inlet opening positioned in the positive pressure area. The positive pressure area in the intake layer has a pressure greater than the atmospheric pressure outside the termination and in the exhaust layer to prevent flow in the exhaust tube from being reversed.

In another embodiment, the plurality of openings is formed by at least one frustoconical ring spaced apart from an enclosure portion. The openings are formed between the frustoconical ring and the enclosure portion. The angle of the openings is defined by the angle between a lower edge and an upper edge of the frustoconical ring.

In another embodiment, the frustoconical ring is spaced apart from the enclosure portion by a plurality of flaps, wherein the flaps are oriented radially.

In another embodiment, the termination assembly has at least two frustoconical rings spaced apart by the flaps.

In another embodiment, a first frustoconical ring has a first angle, and a second frustoconical ring has a second angle different than the first angle.

In another embodiment, the angle is in the range of 20-degrees to 80-degrees to a longitudinal axis of the positive pressure enclosure.

In another embodiment, the frustoconical ring has a circular-shaped circumference along a cross-section.

In another embodiment, the frustoconical ring has a polygonal-shaped circumference along a cross-section.

In another embodiment, the exhaust tube extends through the intake layer.

In another embodiment, the exhaust tube and intake tube are arranged coaxially.

In another embodiment, the exhaust tube is arranged inside the intake tube.

In another embodiment, the exhaust tube and intake tube are arranged collinearly.

In another embodiment, the plurality of openings is formed by a plurality of louvers.

In another embodiment, the louvers are formed integrally in the positive pressure enclosure.

In another embodiment, the intake layer is separated from the exhaust layer by a first plate, wherein the exhaust tube extends through the first plate.

In another embodiment, the intake layer is defined between the first plate and a second plate opposite the first plate, wherein the exhaust tube and intake tube extend through the second plate.

In another embodiment, each of the plurality of openings has a cross-sectional area that decreases from an exterior surface of the enclosure toward the positive pressure area of the enclosure.

In at least one embodiment, a termination assembly for a chimney is provided having an exhaust layer with an exhaust tube adapted to receive exhaust air from an appliance. An outlet opening of the exhaust tube terminates in the exhaust layer. An intake layer is separated from the exhaust layer. The intake layer has an enclosure defining a positive pressure area within the enclosure and a plurality of openings. Each of openings has a cross-sectional area that decreases from an exterior surface of the enclosure toward the positive pressure area within the enclosure. An intake tube is adapted to receive intake air at an inlet opening positioned in the positive pressure area. The positive pressure area in the intake layer has a pressure greater than the atmospheric pressure outside the termination and in the exhaust layer to prevent flow in the exhaust tube from being reversed.

In another embodiment, the enclosure comprises at least two rings spaced apart by a plurality of flaps, wherein the flaps are oriented radially. The plurality of openings is formed between the two rings and two adjacent flaps.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

To operate correctly, direct vent appliances, such as fireplaces or furnaces, must exhaust the burnt gas via a dedicated exhaust and pull in fresh air for combustion from a dedicated intake. The design of these appliances, and the specialty gas terminations which serve them require that the exhaust gases flows on the exhaust side of the system and the intake air flows on the intake side of system for the fireplace to start correctly upon ignition and flow correctly within the appliance. Correct airflow provides for efficient combustion by providing enough oxygen, such as a stoichiometric combustion. The correct airflow may also provide internal air wash systems for the glass front of fireplaces.

A direct vent gas fireplace will not function correctly if it is suffering from reverse flow. Reverse flow is simply the exhaust side of the vent termination acting as the intake side of the system and the intake side of the system functioning as the exhaust side. When reverse flow occurs, exhaust is drawn back into the vent system and the fireplace can 'starve' from not having enough oxygen for combustion within the exhaust gases. Reverse flow may also inhibit proper function of the appliance. In the event of a direct vent gas fireplace which has a larger exhaust vent tube diameter than the intake vent tube, there simply is not enough pipe and termination volume to exhaust the exhaust gases for the fireplace thus creating a restriction that prevents proper operations or causes the fireplace to shut down via its internal operational or safety settings.

Figure 1:
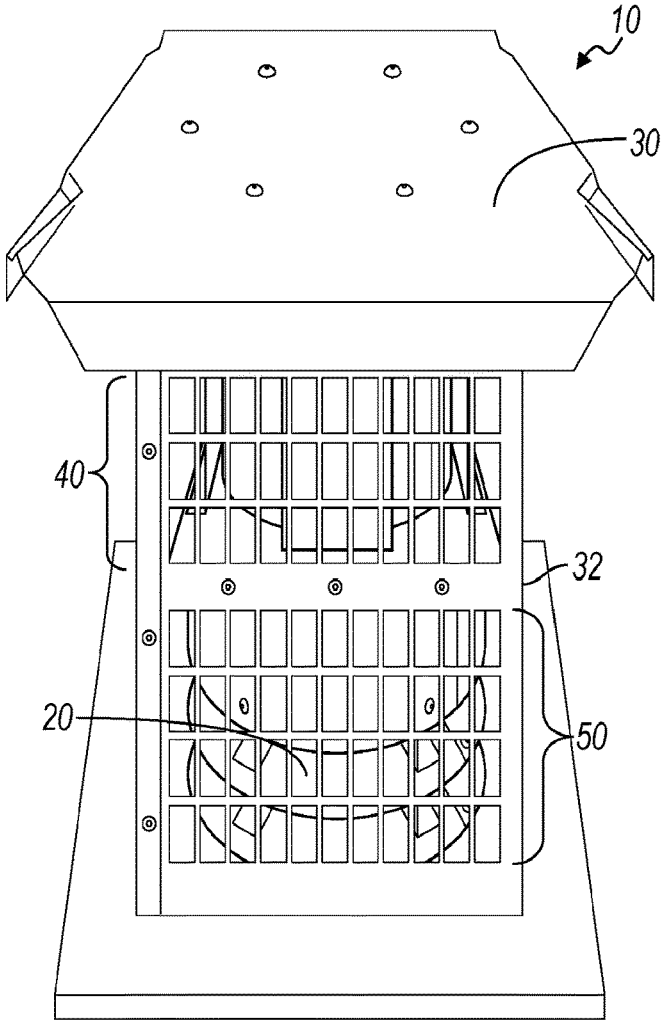
FIG. 1 is a perspective view of a chimney termination assembly including the positive pressure device of the present disclosure.

The device chimney termination assembly 10 having a positive pressure enclosure 20 of the present application prevents reverse flow and creates positive pressure on the intake side of the vent system adjacent the intake vent. FIG. 1 illustrates a chimney termination assembly 10 having the positive pressure enclosure 20, shown in more detail in FIGS. 2-5.

The positive pressure enclosure 20 for a direct vent gas termination may be attached to the termination assembly 10 or formed as part of the termination assembly 10. The positive pressure enclosure 20 channels air into an enclosed or semi-enclosed space via openings 28 in an intake layer 50 having the intake tube 62. A Venturi effect is observed when the air enters the intake layer through the constricted openings 28. The air speed increases through the openings 28, while pressure decreases according to the Venturi effect and Bernoulli's principle. Once the air flows within the enclosure 20, the airspeed decreases and pressure increases, creating a positive pressure area 54 within the enclosure 20 that has a pressure greater than the atmospheric pressure and greater than an exhaust layer 40 to ensure that air driven into the termination assembly 10 by wind in a flows easier an intake layer 50 than air can flow out. This drives air into intake tube 62 to be used as combustion air in the appliance and ensures combusted exhaust air to flow out of the exhaust tube 46.

Figure 2:
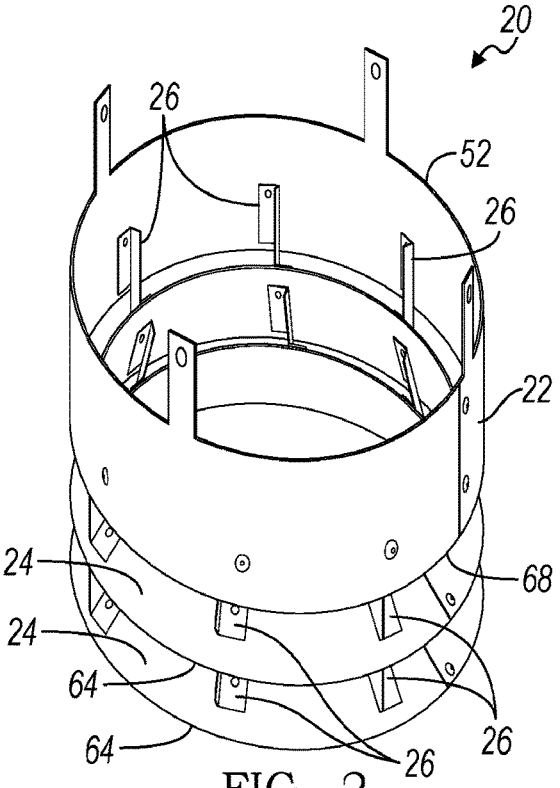
FIG. 2 is a top perspective view of the positive pressure device of the present disclosure.

As shown in FIG. 2, the positive pressure enclosure 20 is formed of a rain guard ring 22 positioned above pressure creator rings 24. As illustrated, the rain guard ring 22 and pressure creator rings 24 have a generally circular cross section. However, the rain guard ring 22 and pressure creator rings 24 may have other cross-sectional shapes, such as polygonal or other suitable shapes.

In the illustrated embodiment, the rain guard ring 22 is generally cylindrical. The pressure creator rings 24 slopes inward and upward towards the rain guard ring 22 and forms a generally conical shape that is truncated, or frustoconical.

The rings 24 are spaced apart from the rain guard ring 22 and from adjacent rings 24 by flaps 26. The flaps 26 are angularly aligned to be parallel to the lateral conical surface of the pressure creator rings 24. As such, the flaps 26 are not parallel to each other and are angled to direct incoming airflow into the positive pressure enclosure 20.

Referring back to FIG. 1, the termination assembly 10 includes a lid 30. The lid 30 forms the top of the termination assembly. The intake and exhaust assemblies are housed inside an outer body 32 that forms the outside of the termination. As shown, the outer body 32 has a grill or mesh along an outer surface to prevent debris such as leaves from getting into the intake or exhaust assemblies. In another embodiment, the body 32 may be rectangular, or another suitable shape. In a further embodiment, the positive pressure enclosure 20 may be formed integrally with the body along the outer surface.

The termination assembly 10 has an exhaust layer 40. The exhaust layer 40 is connected to the lid 30 and extends below the lower side of the lid 30. As shown, the exhaust layer 40 has wind baffles 42.

A first plate 44, or exhaust plate, defines the bottom of the exhaust layer 40. The plate 44 defines an opening 48 that cooperates with an exhaust tube 46. Exhaust air from the appliance flows through the exhaust tube 46 and exits the termination at the exhaust layer 40 in the opening between the wind baffles 42. The exhaust tube 46 extends through the opening 48 into the exhaust layer 40.

The plate 44 separates the exhaust layer 40 from an intake layer 50. The positive pressure enclosure 20 is positioned on the intake layer 50. The exhaust tube 46 extends through the intake layer 50, but does not have any opening along the intake layer 50.

An upper surface 52 of the positive pressure enclosure 20 abuts the exhaust plate 44. A second plate 60 forms the bottom of the intake layer 50. The positive pressure enclosure 20 has a pressure creating zone 54 or cavity that is defined inside the rings 22, 24 and between plate 44 and the intake plate 60. A second plate 60 forms the bottom surface or mounting surface of the termination assembly 10.

Figure 7:
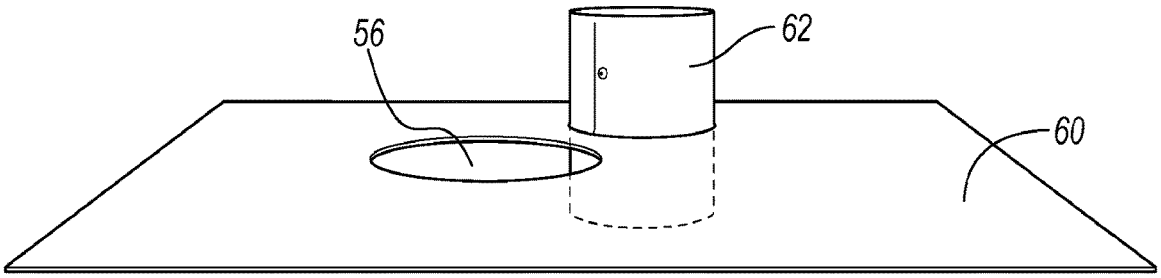
FIG. 7 shows a lower plate of the chimney termination assembly according to one embodiment.

As shown in FIG. 7, the second plate 60 has two openings. The intake tube 62 extends through the plate 60. The plate 60 also has vent tube opening 56 through which the exhaust tube 46 extends. The plate 60 abuts a lower edge 64 of the positive pressure enclosure 20. The lower edge 64 is defined by the lower opening of the lower ring 24.

Figure 3:
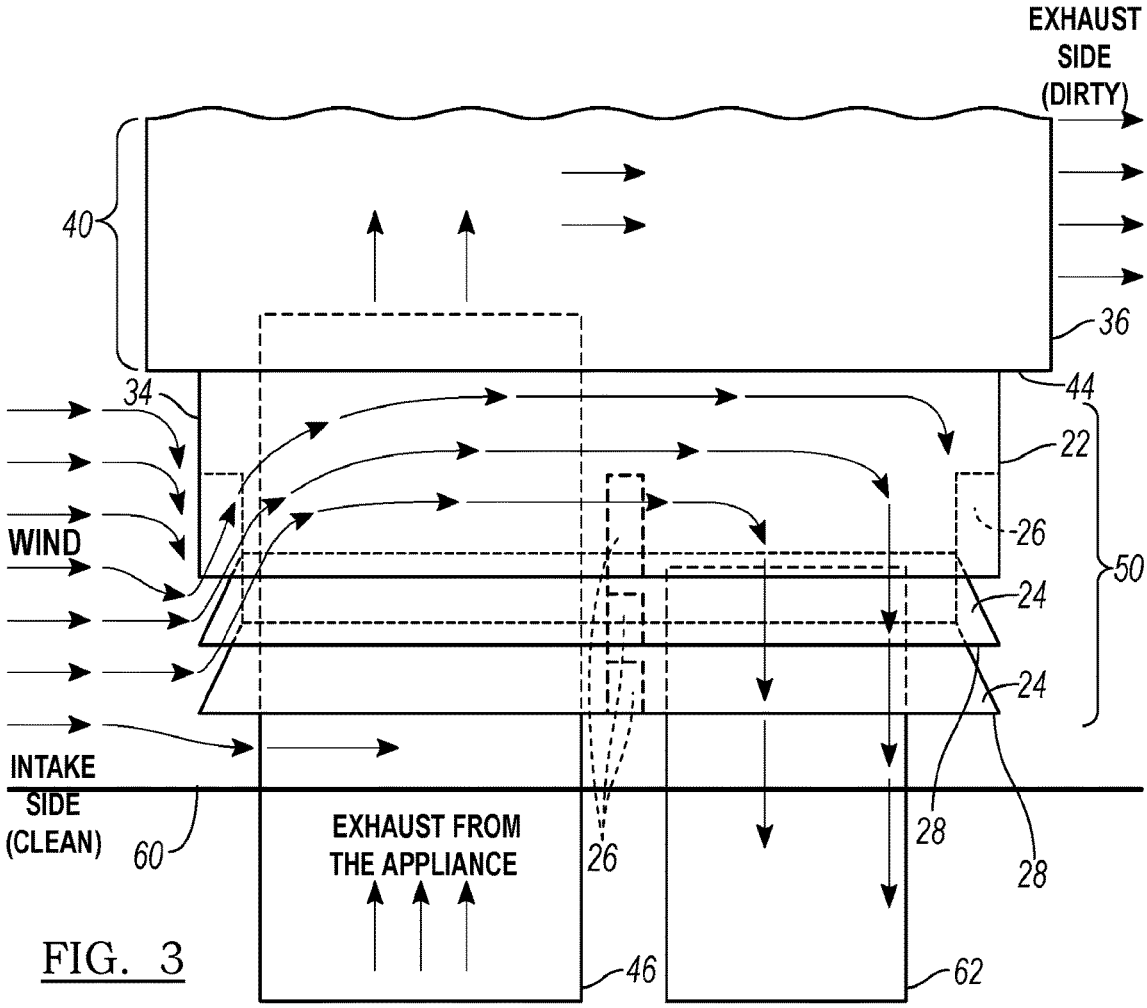
FIG. 3 is a section view of a portion of the chimney termination including the positive pressure device showing airflow creating positive pressure.

FIG. 3 illustrates a section view of a portion of the chimney termination assembly 10 and the positive pressure enclosure 20. As shown, the exhaust tube 46 terminates in the exhaust layer 40 at an outlet opening 70. The intake tube 62 originates in the intake layer 50 at an inlet opening 72.

As shown in FIG. 3, clean air enters the intake layer 50 along the intake, or windward side 34 based on the wind direction. Clean air is directed upward and inward by the angled openings between the frustoconical rings 24. The angled openings 28 have a cross-sectional area that decreases from an exterior surface of the enclosure 20 toward the positive pressure area 54 within the enclosure 20. This creates positive pressure in a zone around the intake opening 72 of the intake tube 62. The positive pressure enclosure 20 makes it more difficult for the clean air to exit the intake layer 50 on a leeward side 36, instead, the clean intake air enters the intake tube 62. 'Dirty' combusted air exits on the exhaust side 36, opposite the intake side 34 so that there is not a risk of exhaust air entering the intake.

Figure 4:
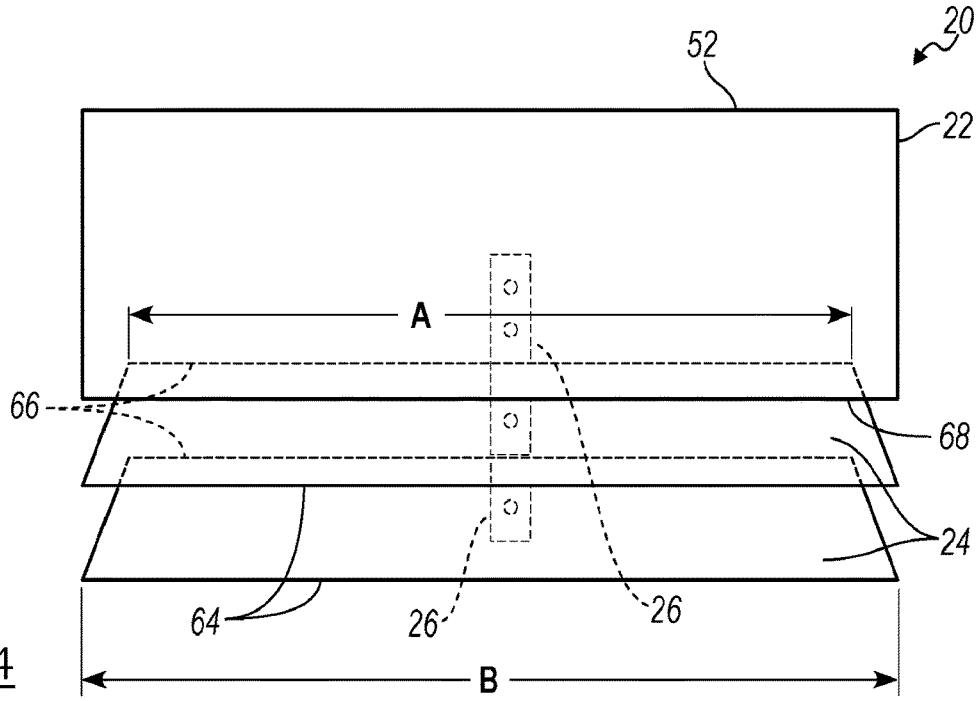
FIG. 4 is a section view of the positive pressure device of FIG. 2.

As shown in the section view of the positive pressure enclosure 20 in FIG. 4, the conical rings 24 have an upper edge 66 that is positioned inward and above the lower edge 68 of the rain guard ring 22. The upper edge 66 has a diameter A, as shown in FIG. 4. The lower edge 64 of the rings 24 has a diameter B and is general equal to the cylindrical opening 68 of the rain guard ring 22. The diameter A of the upper edge 66 is less than the diameter of the lower edge B. The angle defined between the lower edge 64 and the upper edge 66 may in the range of 20-degrees to 85-degrees to a central longitudinal axis 80 of the positive pressure enclosure 20. As shown, the angle is approximately 70-degrees. The positive pressure enclosure 20 may also be oriented so the openings 28 defined by the rings 22, 24 are angled downward.

The flaps 26 are also angularly oriented relative to the pressure creator rings 24. As such, the flaps 26 are not parallel to each other and are angled to constrict and/or direct incoming airflow into the positive pressure enclosure 20. Adjacent flaps 26 are oriented at converging angles toward the inside of the enclosure 20. Together with the frustoconical rings 24, the flaps 26 define the plurality of openings 28 along the enclosure 20 that have a decreasing cross-section. As the openings narrow, airflow is constricted, and airflow speed is increased due to a venturi effect. This makes it easier for air to enter the enclosure 20, than for air to exit and creates the positive pressure area 54.

Figure 10A:
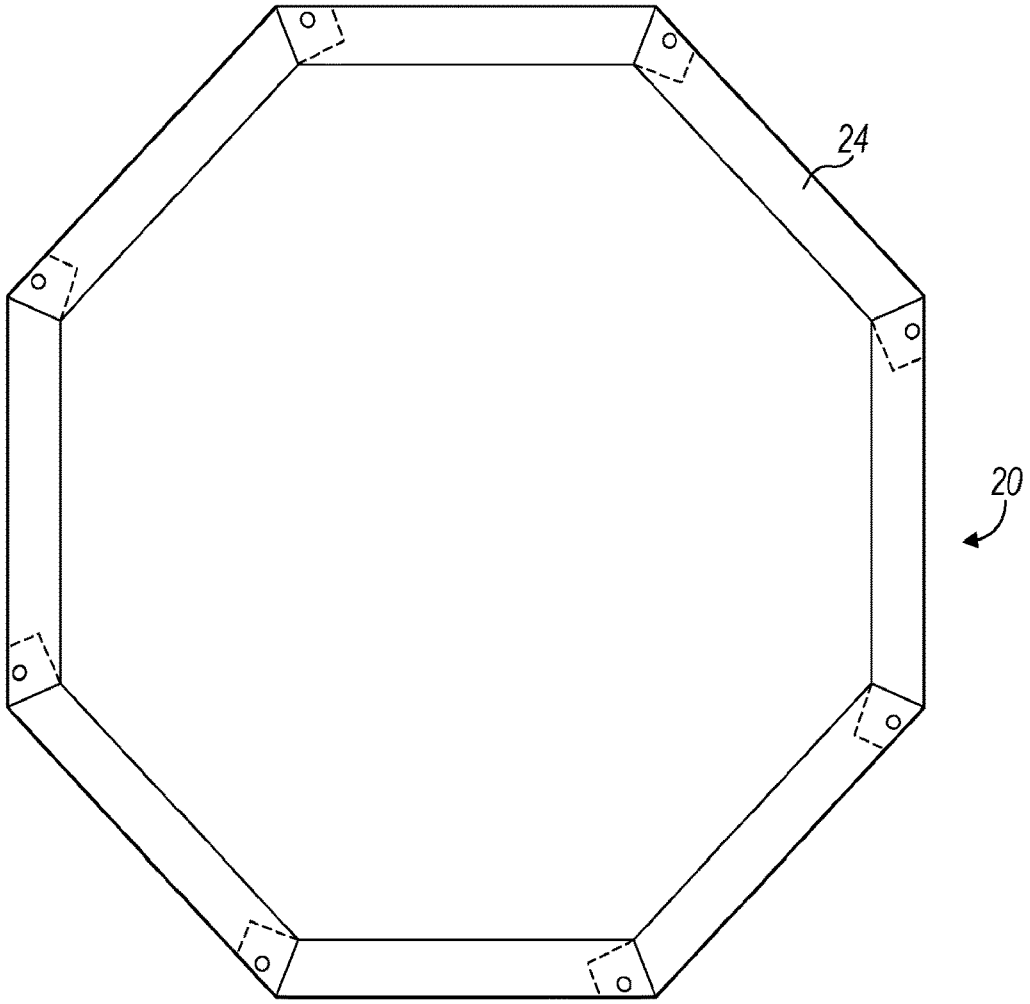
FIG. 10 is a section view through the chimney termination device according to another embodiment.
Figure 10B:
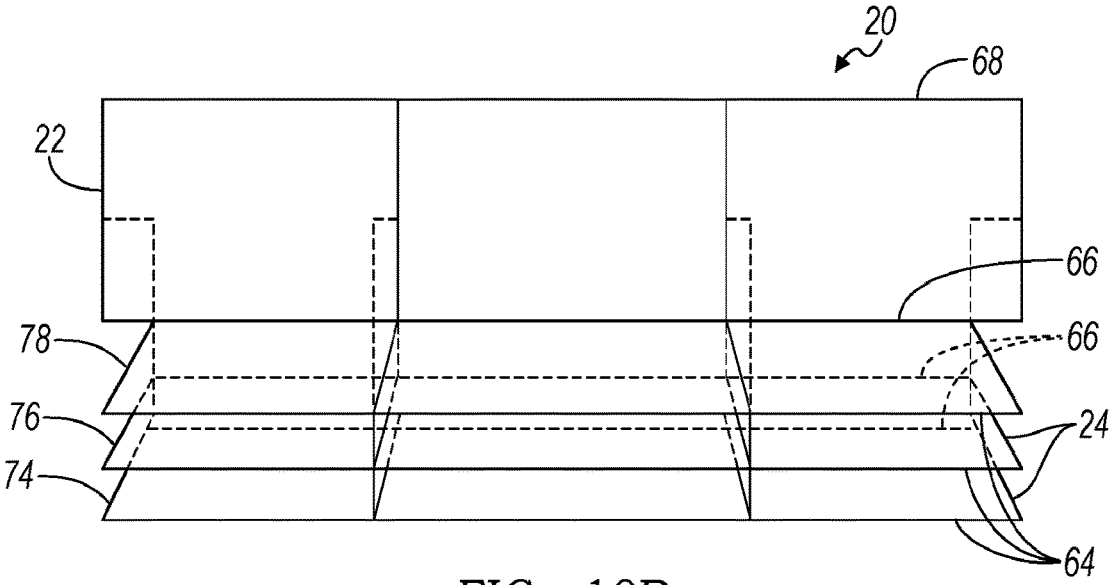

As shown in FIG. 10, the angled rings 24 may be shaped to have different angles between the lower edge 64 and the upper edge 66 to create openings 28 at different angles to restrict airflow along the length of the opening channels. For example, as shown in FIG. 10, a lower ring 74 is oriented at a steeper angle than an upper ring 76. In one example, the upper ring 76 may have an of 69-degrees, while the lower ring 74 has a steeper angle of 73-degrees between the lower edge 64 and upper edge 66.

In the embodiment shown, the enclosure 20 has two pressure creator rings 24. However, other numbers of pressure creator rings may be utilized. For example, the enclosure 20 may have one pressure creator ring 24, or three of more pressure creator rings 24. In another embodiment, the positive pressure enclosure 20 may be rectangular, other polygonal or another geometric cross-section and the pressure creator rings 24 may have corresponding slanted lateral walls extending between the smaller upper edge 66 and the larger-circumference lower edge 64. For example, FIG. 10 illustrates a positive pressure enclosure 20 being octagonal and having pressure creator rings 24 having an octagonal periphery.

Figure 5:
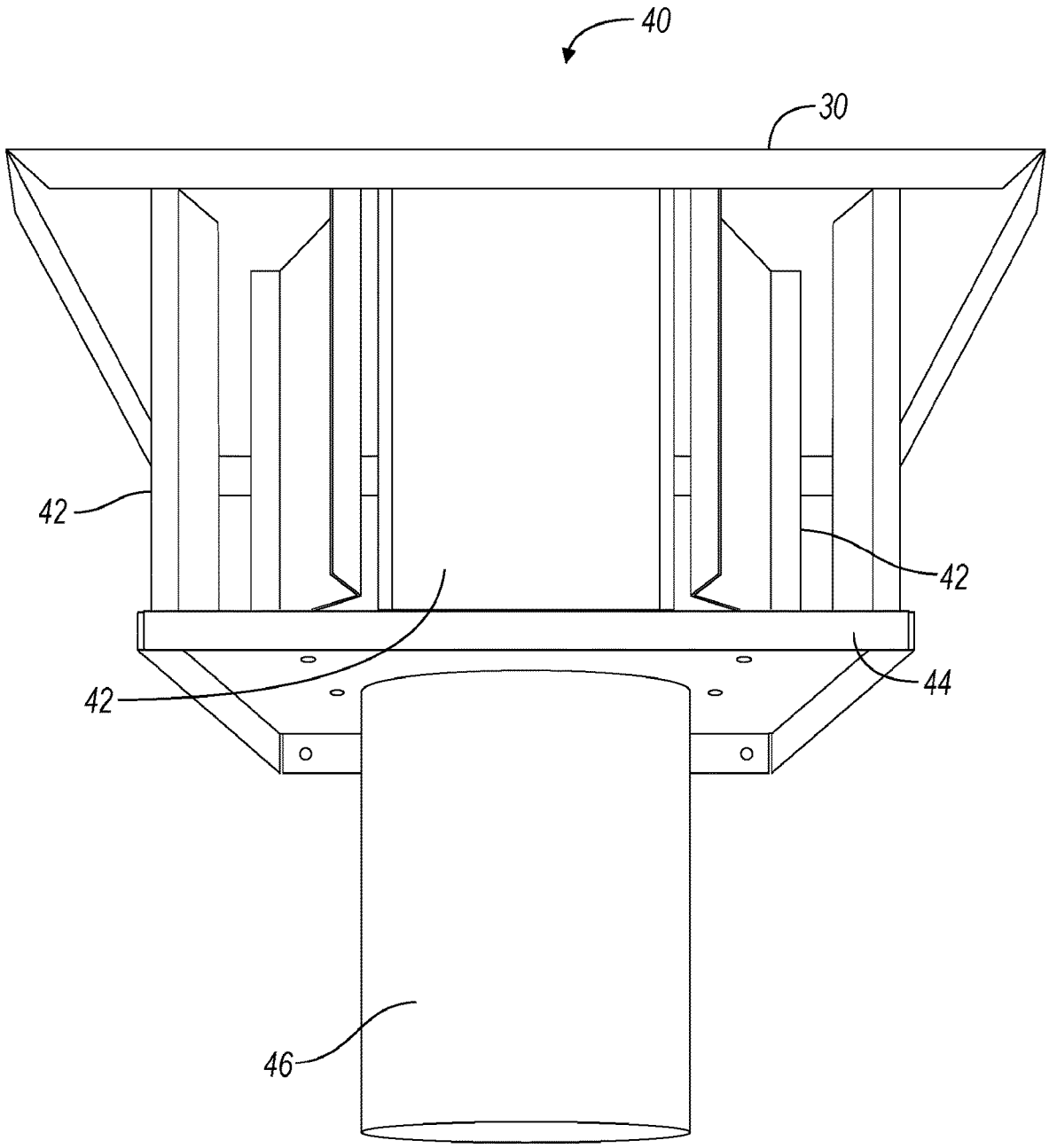
FIG. 5 is a perspective view of an exhaust layer of the chimney termination of FIG. 1.
Figure 6:
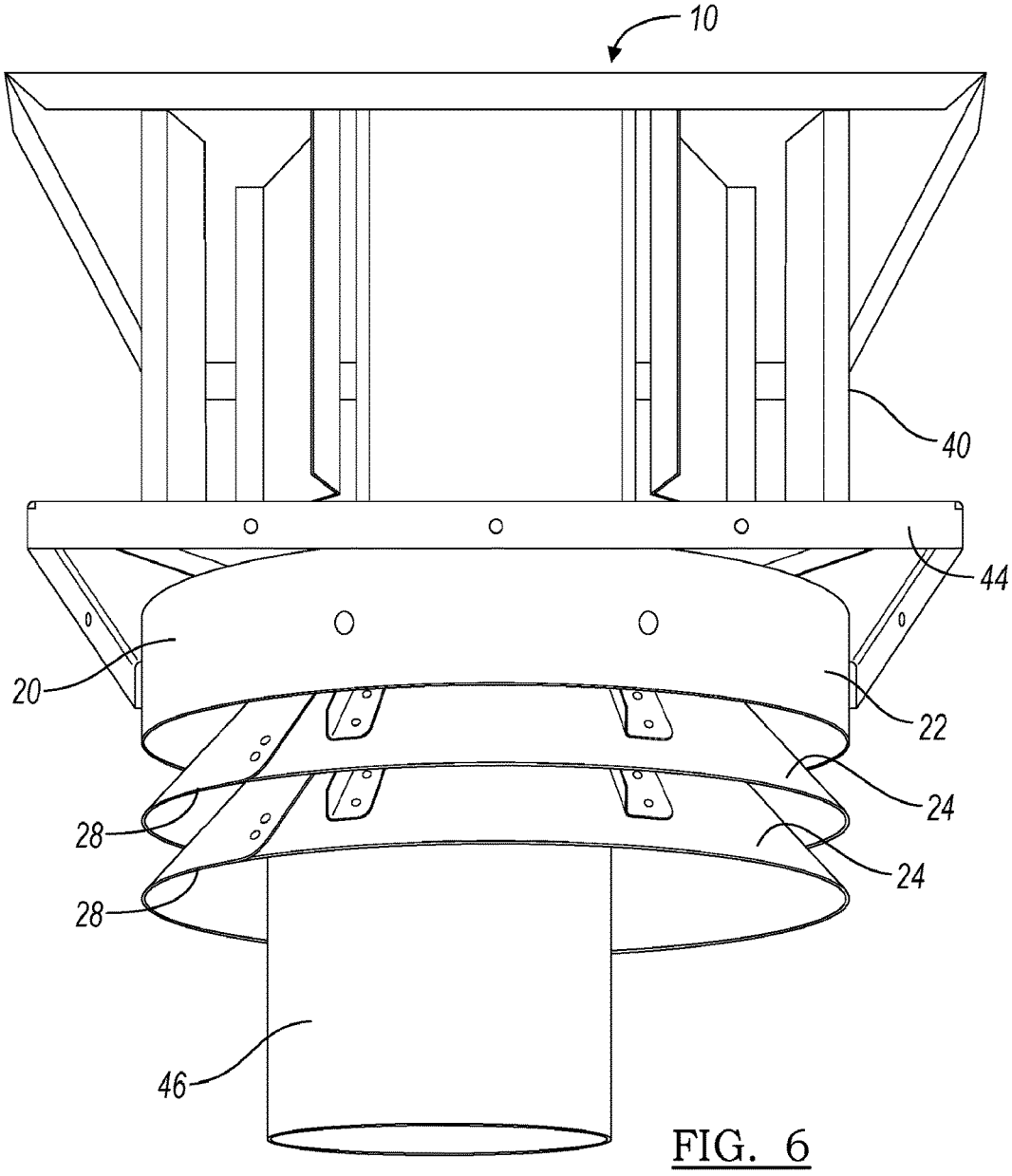
FIG. 6 shows the positive pressure device connected to the exhaust layer in FIG. 5.

FIG. 5 shows the exhaust layer 40 removed from the body 32 of the chimney termination 10. In FIG. 6, the positive pressure enclosure 20 is connected to the exhaust layer 40 so the upper surface 52 abuts the exhaust plate 44. While the exhaust layer 40 is illustrated above the intake layer 50, the intake layer 50 and enclosure 20 may also be positioned above the exhaust layer.

FIG. 7 illustrates the intake plate 60 removed from the body 32 of the chimney termination 10. The intake plate 60 has an opening for the exhaust tube 46. The intake tube 62 extends through the intake plate 60. The intake plate 60 shows an embodiment where the intake tube and exhaust tube are co-linear. Collinear refers to a term used in the industry term referring to parallel, but spaced apart intake and exhaust tubes. The intake plate 60 has an opening for the exhaust tube, but the exhaust tube extends through the intake layer to the exhaust layer.

Figure 8:
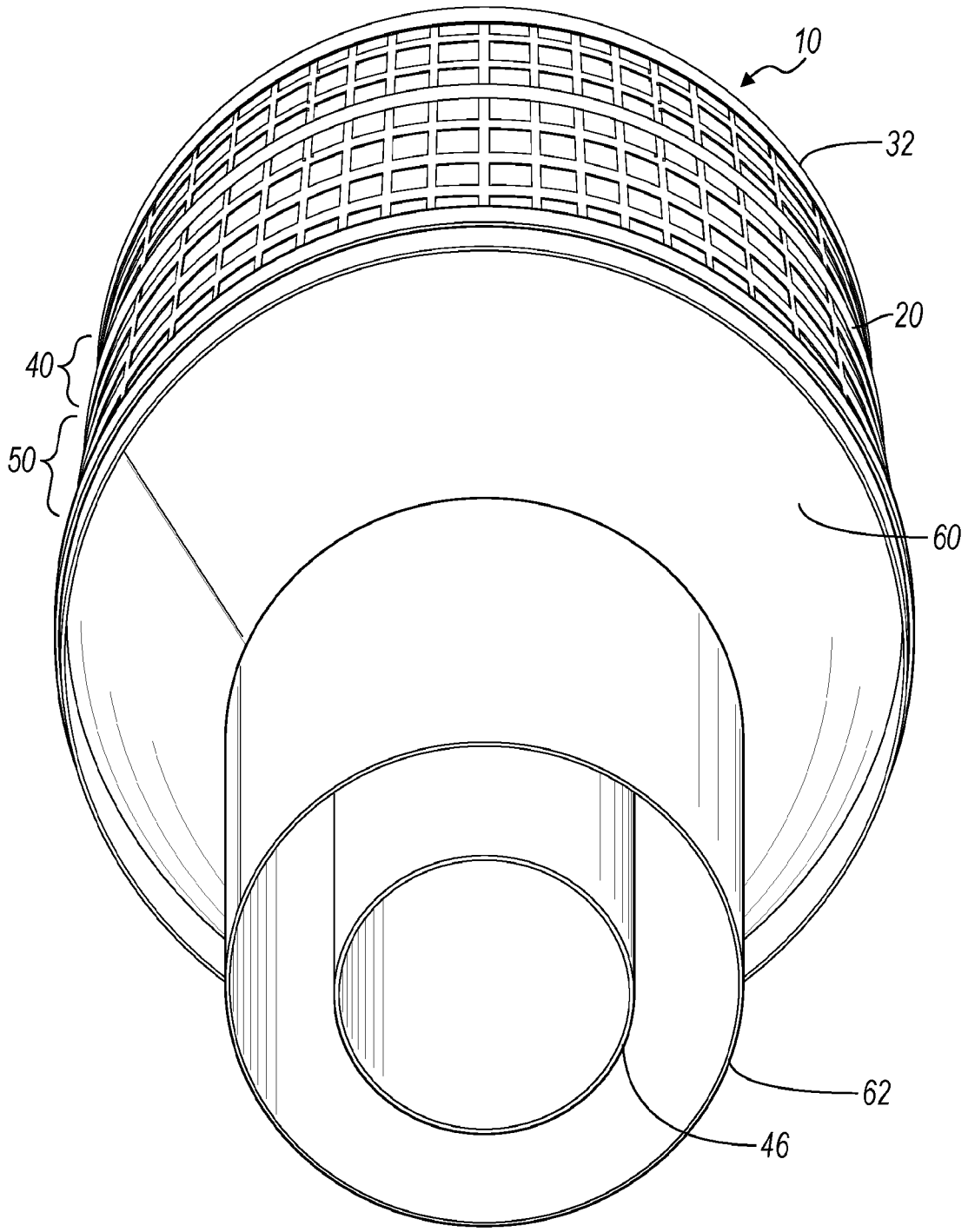
FIG. 8 shows a lower perspective view of a chimney termination assembly according to another embodiment.

FIG. 8 shows a lower perspective view of a chimney termination assembly where the intake tube 62 and exhaust tube 46 are coaxial. The exhaust tube 46 and intake tube 62 are centered about the same axis. As shown, the exhaust tube 46 is the inner tube, and the intake tube 62 is the outer tube. As shown in FIG. 8, the exhaust tube 46 and intake tube 62 are generally centered along a central longitudinal axis 80 of the termination assembly 10. However, the exhaust tuber 46 and intake tube 62 may share an axis that is offset from the central longitudinal axis of the termination assembly 10.

Figure 9:
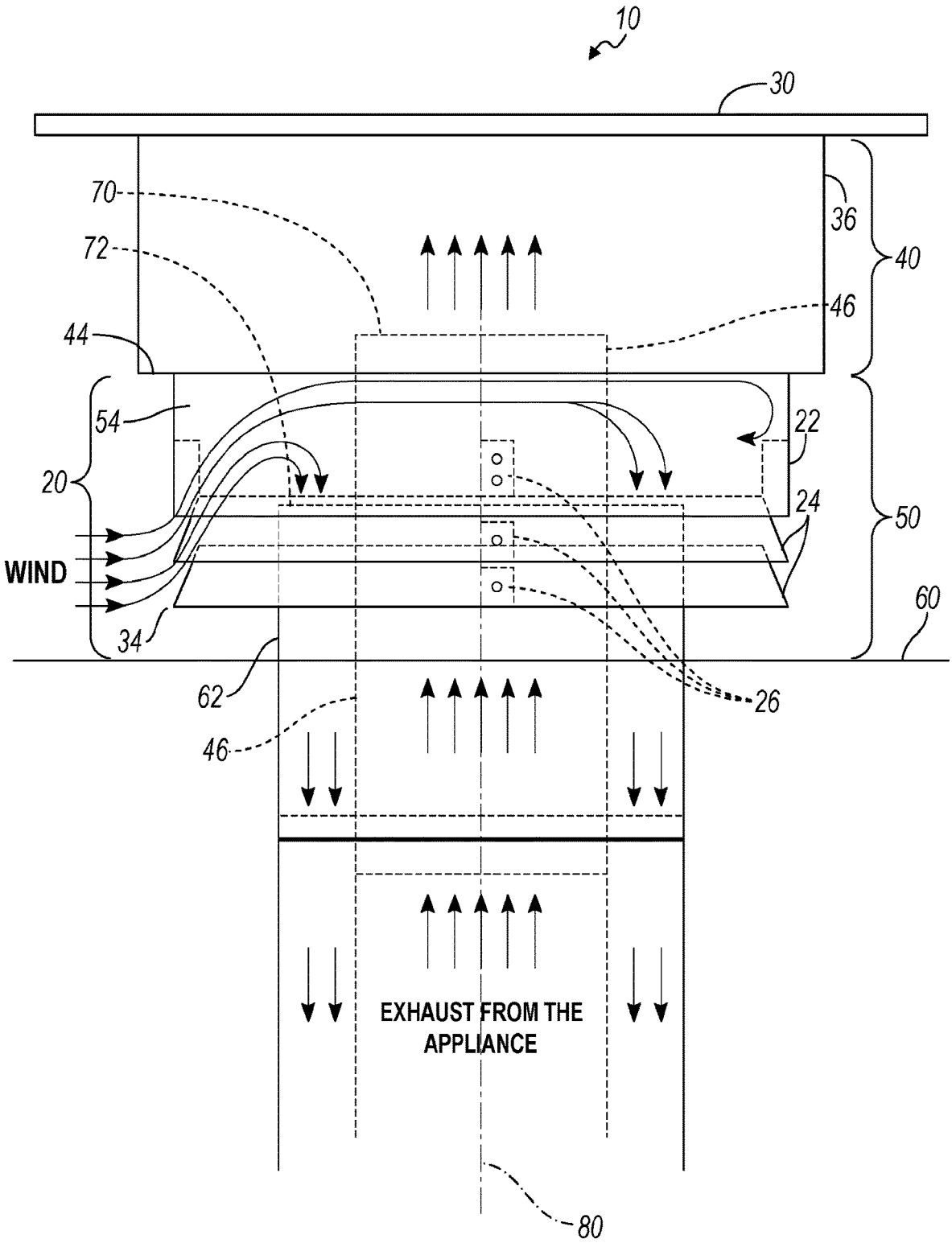
FIG. 9 is a section view through the chimney termination device of FIG. 8 showing airflow creating positive pressure.

FIG. 9 is a section view through the chimney termination assembly 10 of FIG. 8 showing airflow creating positive pressure in the co-axial embodiment. Wind blows clean air into the intake layer 50 through the openings 28. The clean air is directed upward and inward by the angled openings 28 between the frustoconical rings 24 toward the positive pressure area 54 within the enclosure 20. The inlet opening 72 of the inlet tube 62 is positioned within the intake layer 50 and the positive pressure area 54. 'Dirty' combusted air exits on the exhaust side, opposite the intake side so that there is not a risk of exhaust air entering the intake.

Figure 11:
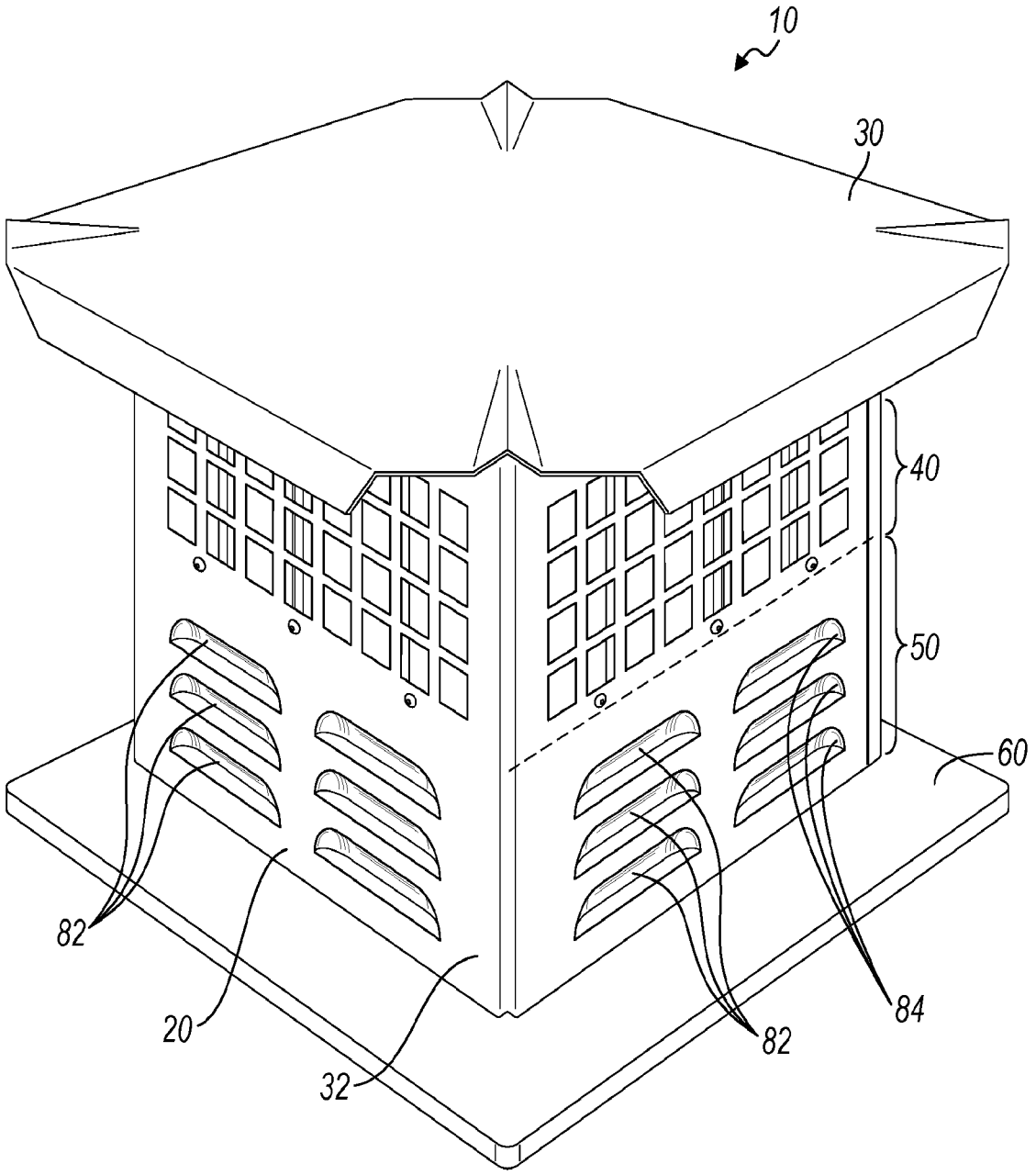
FIG. 11 is a perspective view of a chimney termination device according to another embodiment.

FIG. 11 is a perspective view of a chimney termination assembly 10 showing a positive pressure enclosure 20 having openings 28 formed with louvers 82. As shown in FIG. 11, the positive pressure enclosure 20 may be formed integrally with the outer body 32 of the termination 10. The body may have angled slots, or a series of louvers 82 extending inward from the exterior surface of the body 32. The body 32 may be cylindrical having a circular or rectangular cross-section or other geometric cross section. As shown in FIG. 11, the louvers 82 extend inward from the exterior surface and are angled downward. The louvers 82 may also be oriented to slope upward. The louvers 82 may be formed integral with the body 32 using a die to punch the louvers 82.

The louvers 82 may be shaped as a scoop and enclosed on the sides 84. The side walls 84 of the louver 82 may be angled inward so the opening area of the louver 82 decreases from the exterior to the interior of the enclosure 20 to create positive pressure. The enclosure 20 may include a plurality of louvers 82 in an array, such as the three rows with two louvers 82 as shown. The louvers 82 may also be formed as elongated openings.

The rain guard ring 22 may also be part of the outer body 32 of the termination and may be square, as shown in FIG. 11, or round, polygonal or other suitable geometry. That part of the body can be left "unpunched" and attach pressure creating features to the interior of the body directly or as previously noted form them into the body itself.

The following numerals are used in reference to the drawings:

10—termination assembly
20—positive pressure enclosure
22—rain guard ring
24—pressure creator rings
26—flaps
28—openings
30—lid of termination
32—outer body of termination
34—windward/intake side
36—leeward/exhaust side
40—exhaust layer
42—wind baffles
44—plate
46—exhaust tube
50—intake layer
52—upper surface of the positive pressure enclosure
54—pressure creating zone or cavity
56—exhaust vent tube opening in plate
60—second plate
62—intake tube
64—lower edge
66—upper edge
68—cylindrical opening of rain guard ring
70—outlet opening of the exhaust tube
72—inlet opening of the intake tube
80—center longitudinal axis
82—louver
84—side walls of louver While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A termination assembly for a chimney, the termination assembly comprising:
an intake tube adapted to receive intake air to be delivered to an appliance;
an exhaust tube adapted to receive exhaust air from the appliance;
an exhaust layer, wherein the exhaust tube terminates in the exhaust layer;
an intake layer disposed above or below the exhaust layer and mounted to an exhaust plate separating the exhaust layer from the intake layer, the intake layer comprising:
a first ring defining a positive pressure area within the first ring;
at least one frustoconical ring spaced apart from the first ring and defining an exterior opening directing intake air at an angle toward the first ring into a positive pressure area; and
an intake plate mounted to the frustoconical ring opposite the first ring,
wherein the positive pressure area is defined within the first ring and the at least one frustoconical ring and between an exhaust plate and an intake plate, and
wherein the intake tube originates in the positive pressure area.

2. The termination assembly of claim 1, wherein the at least one frustoconical ring has a circumference being at least one of a circular shape or a polygonal shape along a cross-section.

3. A termination assembly for a chimney, the termination assembly comprising:
an exhaust layer having an exhaust tube adapted to receive exhaust air from an appliance, wherein an outlet opening of the exhaust tube terminates in the exhaust layer;
an intake layer separated from the exhaust layer, the intake layer comprising:
an enclosure defining a positive pressure area within the enclosure and the enclosure having a plurality of openings directing intake air at an angle toward the positive pressure area, wherein the angle is in the range of 20-degrees to 85-degrees to a longitudinal axis of the enclosure;
an intake tube adapted to receive intake air at an inlet opening positioned in the positive pressure area;
wherein the positive pressure area in the intake layer has pressure greater than the atmospheric pressure outside the termination assembly and in the exhaust layer to prevent flow in the exhaust tube from being reversed.

4. The termination assembly of claim 3, wherein the plurality of openings is formed by at least one frustoconical ring spaced apart from an enclosure portion, the plurality of openings formed between the at least one frustoconical ring and the enclosure portion, wherein the angle of the plurality of openings is defined by the angle between a lower edge and an upper edge of the at least one frustoconical ring.

5. The termination assembly of claim 4, wherein the at least one frustoconical ring is spaced apart from the enclosure portion by a plurality of flaps, wherein the plurality of flaps are oriented radially.

6. The termination assembly of claim 5, wherein the at least one frustoconical ring comprises at least two frustoconical rings spaced apart by the plurality of flaps.

7. The termination assembly of claim 6, wherein the at least two frustoconical rings comprises a first frustoconical ring having a first angle, and a second frustoconical ring having a second angle different than the first angle.

8. The termination assembly of claim 4, wherein the at least one frustoconical ring has a circumference being at least one of a circular shape or a polygonal shape along a cross-section.

9. The termination assembly of claim 3, wherein the exhaust tube extends through the intake layer.

10. The termination assembly of claim 3, wherein the exhaust tube and intake tube are arranged coaxially.

11. The termination assembly of claim 10, wherein the exhaust tube is arranged inside the intake tube.

12. The termination assembly of claim 3, wherein the exhaust tube and intake tube are arranged collinearly.

13. The termination assembly of claim 3, wherein the plurality of openings is formed by a plurality of louvers.

14. The termination assembly of claim 13, wherein the plurality of louvers are formed integrally in the enclosure.

15. The termination assembly of claim 3, wherein the intake layer is separated from the exhaust layer by a first plate, wherein the exhaust tube extends through the first plate.

16. The termination assembly of claim 3, wherein the intake layer is defined between a first plate and a second plate opposite the first plate, wherein the exhaust tube and intake tube extend through the second plate.

17. The termination assembly of claim 3, wherein each of the plurality of openings has a cross-sectional area that decreases from an exterior surface of the enclosure toward the positive pressure area of the enclosure.

18. A termination assembly for a chimney, the termination assembly comprising:

an exhaust layer having an exhaust tube adapted to receive exhaust air from an appliance, wherein an outlet opening of the exhaust tube terminates in the exhaust layer;

an intake layer separated from the exhaust layer, the intake layer comprising:

an enclosure defining a positive pressure area within the enclosure and the enclosure having at least one opening formed between at least two rings being spaced apart, wherein the at least one opening has a cross-sectional area that decreases from an exterior surface of the enclosure toward the positive pressure area within the enclosure;

an intake tube adapted to receive intake air at an inlet opening positioned in the positive pressure area;

wherein the positive pressure area in the intake layer has pressure greater than the atmospheric pressure outside the termination assembly and in the exhaust layer to prevent flow in the exhaust tube from being reversed.

19. The termination assembly of claim 18, wherein the at least one opening comprises a plurality of openings, and wherein the at least two rings are spaced apart by a plurality of flaps oriented radially, wherein the plurality of openings is formed between the at least two rings and two adjacent flaps.

20. The termination assembly of claim 18, wherein the at least two rings have a circumference being at least one of a circular shape or a polygonal shape along a cross-section.

* * * * *